US010477327B2

(12) United States Patent
Pedersen

(10) Patent No.: US 10,477,327 B2
(45) Date of Patent: Nov. 12, 2019

(54) PRIVATE AUDIO STREAMING AT POINT OF SALE

(71) Applicant: GN HEARING A/S, Ballerup (DK)

(72) Inventor: Brian Dam Pedersen, Ringsted (DK)

(73) Assignee: GN HEARING A/S, Ballerup (DK)

( * ) Notice: Subject to any disclaimer, the term of this patent is extended or adjusted under 35 U.S.C. 154(b) by 24 days.

(21) Appl. No.: 14/062,232

(22) Filed: Oct. 24, 2013

(65) Prior Publication Data

US 2015/0110314 A1 Apr. 23, 2015

(30) Foreign Application Priority Data

Oct. 22, 2013 (DK) ..... 2013 70605
Oct. 22, 2013 (EP) ..... 13189628

(51) Int. Cl.
*H04R 25/00* (2006.01)
*H04R 3/12* (2006.01)

(52) U.S. Cl.
CPC ..... *H04R 25/554* (2013.01); *H04R 3/12* (2013.01); *H04R 2420/07* (2013.01)

(58) Field of Classification Search
CPC ..... H04B 15/00
USPC ..... 381/315, 320, 23.1, 55, 58, 71.14, 81, 381/94.3, 150, 402
See application file for complete search history.

(56) References Cited

U.S. PATENT DOCUMENTS 8,194,902 B2 6/2012 Pedersen
2004/0179510 A1 9/2004 Kuffner et al.
2004/0208324 A1 10/2004 Cheung et al.
2006/0025206 A1* 2/2006 Walker ..... G07F 17/32 463/20
2007/0230736 A1* 10/2007 Boesen ..... H04M 1/05 381/380
2010/0020978 A1 1/2010 Garudadri et al.
2010/0054512 A1 4/2010 Solum
2012/0115421 A1* 5/2012 Wu ..... H04H 20/62 455/62
2012/0321112 A1 12/2012 Schubert et al.
(Continued)

FOREIGN PATENT DOCUMENTS

CN 101421995 A 4/2009
EP 2 200 344 6/2010
(Continued)

OTHER PUBLICATIONS

Second technical examination—Intention to Grant dated Sep. 29, 2014 for related Danish Patent Application No. PA 2013 70605, 2 pages.

(Continued)

*Primary Examiner* — Yosef K Laekemariam
(74) *Attorney, Agent, or Firm* — Vista IP Law Group, LLP

(57) ABSTRACT

A point of sale system includes: a transceiver; an activator; and a processing unit; wherein the transceiver is configured for, upon activation of the activator, detecting radio frequency signals transmitted from at least one device; wherein the processing unit is configured for: associating a measurement value with each of the at least one device, selecting a device from the at least one device for reception of an audio stream, based on the measurement value of the device fulfilling at least one selection criteria, and operating the transceiver to transmit the audio stream to the selected device.

19 Claims, 3 Drawing Sheets

(56) References Cited

U.S. PATENT DOCUMENTS

| | | | | |
|---|---|---|---|---|
| 2013/0039510 | A1 | 2/2013 | Pelland et al. | |
| 2013/0157573 | A1* | 6/2013 | Aldaz ..... | H04M 1/6066<br>455/41.2 |

FOREIGN PATENT DOCUMENTS

| | | | |
|---|---|---|---|
| WO | WO 03/100348 | | 12/2003 |
| WO | WO 2007/121334 | | 10/2007 |
| WO | WO 07121414 | A2 | 10/2007 |
| WO | WO 07121414 | A3 | 10/2007 |
| WO | 2011/015675 | A2 | 2/2011 |
| WO | WO 2011/015675 | | 2/2011 |
| WO | WO 2012/135677 | | 10/2012 |
| WO | WO 2013/131029 | | 9/2013 |

OTHER PUBLICATIONS

First Office Action w/ Search Report and English translation dated Nov. 30, 2017 for corresponding Chinese Application No. 201410569418.4. 02.

Extended European Search Report for EP Patent Application No. 13189628.4 dated Feb. 24, 2014 (8 pages).

First technical examination and search report dated Jul. 10, 2014 for related Danish Patent Application No. PA 2013 70605, 3 pages.

* cited by examiner 305 302 303 304

| Associated device | Identifier | Measured signal strength received by 21 | Supports audio streaming |
|---|---|---|---|
| device 4 | device 3 | 4 | 1 |
| | device 5 | 3 | 1 |
| device 3 | device 4 | 2 | 1 |
| | device 6 | 1 | 0 |
| | | | |

301

*Fig. 3*

PRIVATE AUDIO STREAMING AT POINT OF SALE

RELATED APPLICATION DATA

This application claims priority to and the benefit of Danish Patent Application No. PA 2013 70605, filed on Oct. 22, 2013, pending, and European Patent Application No. EP 13189628.4, filed on Oct. 22, 2013, pending. The entire disclosures of both of the above applications are expressly incorporated by reference herein.

FIELD

The present specification relates to a point of sale configured for securely streaming of audio data. Additionally, the specification relates to a method of securely streaming of audio data.

BACKGROUND

Telecoils in hearing devices are to be replaced by long range radio-frequency (RF) based audio streaming systems at points of sale (POS) such as a ticket office, a bank, a post office, etc. It is possible to eavesdrop on such long range RF systems and therefore there may exist a privacy issue with such systems.

WO 2011/0015675 discloses a system for providing hearing assistance to a user, comprising at least one audio signal transmission unit comprising an audio signal source, typically a microphone arrangement, and means for transmitting audio signals from the audio signal source via a wireless radio frequency link to a left ear receiver unit worn at the user's left ear and a right ear receiver unit worn at the user's right ear.

US 2004/0208324 discloses a directional audio delivery device for an audio system. The audio delivery device provides directional delivery of audio output for the audio system. The generated audio output is substantially confined in one or more beams, each with a beam width. The output is targeted to one or more persons who would like to hear the audio output.

US 2004/0179510 discloses a communications method including the steps of: activating a plurality of signal sources, and transmitting a synchronization event to the plurality of signal sources to cause the plurality of signal sources to simultaneously transmit data in response to the synchronization event.

Thus, there is a need to provide such long range systems configured for secure streaming of audio data between a point of sale and a hearing device.

SUMMARY

The present application pertains to a point of sale system according to claim 1, and a method of securely streaming of audio data according to claim 14. The above-mentioned and other needs are achieved by a point of sale system according to claim 1 and a method according to claim 14.

In an embodiment, long range RF based audio systems described above and below may be configured for transmitting and/or receiving RF data at distances up to eight to 10 meters.

In an embodiment, long range RF based audio systems described above and below may be configured for transmitting and/or receiving data using a Bluetooth or Bluetooth-like protocol such as disclosed in U.S. Pat. No. 8,194,902 and EP 2 200 344 hereafter incorporated by reference.

In an embodiment, the term secure streaming of audio data may be defined as a transmission of data from a transmitter which data can only be received by an intended receiver. Thereby, eavesdropping is made impossible because the data transmitted from the transmitter can only be received by the proper receiver.

By ensuring that a point of sale streams to a device fulfilling a selection criterion (such as highest/largest RSSI) when an activator (such as a push button) contained in the point of sale or being communicatively coupled to the point of sale, the features according to claim 1 ensures secure streaming of audio data to the device.

By requesting an identifier for a contra-lateral device to the selected device, claim 10 ensures that a contra-lateral device is correctly identified and thereby also ensures secure streaming of audio data to the contra-lateral device.

The method of securely streaming of audio data according to claim 14 and embodiments thereof comprises the same advantages as the point of sale system for the same reasons.

A point of sale system includes: a transceiver; an activator; and a processing unit; wherein the transceiver is configured for, upon activation of the activator, detecting radio frequency signals transmitted from at least one device; wherein the processing unit is configured for: associating a measurement value with each of the at least one device, selecting a device from the at least one device for reception of an audio stream, based on the measurement value of the device fulfilling at least one selection criteria, and operating the transceiver to transmit the audio stream to the selected device.

Optionally, at least one of the at least one device is a hearing device configured for wireless audio streaming.

Optionally, the activator is configured for activation in response to a request from a user of the hearing device for a securely transmitted audio stream to be provided from the point of sale system.

Optionally, the radio frequency signals comprises radio beacons.

Optionally, the measurement value comprises a radio frequency signal strength.

Optionally, the processing unit is configured to assess each of the at least one device according to the measurement value associated with the each of the at least one device.

Optionally, the processing unit is configured to use a strength of the radio frequency signals transmitted from the at least one device as a signal strength indication for data reception by the at least one device at a point of sale.

Optionally, the processing unit is configured to set a receiving value for each of the at least one device indicating whether the each of the at least one device supports audio streaming.

Optionally, the processing unit is configured to select the device also based on the receiving value.

Optionally, the processing unit is further configured for requesting the selected device to provide an identifier of a contralateral device.

Optionally, the transceiver is configured for receiving the identifier from the selected device.

Optionally, the processing unit is configured to operate the transceiver for transmitting the audio stream to the selected device and the contralateral device.

Optionally, the at least one device comprises a plurality of devices, and the selection criteria comprises selecting one of the plurality of devices that has a highest measurement.

A method of streaming audio data from a point of sale system to a hearing device, wherein the point of sale system comprises a transceiver and an activator, includes: activating the activator in response to a request from a user of the hearing device for a securely transmitted audio stream from the point of sale system to the hearing device; searching for radio signals from a plurality of devices including the hearing device receivable by the transceiver of the point of sale system; identifying one of the received radio signals having a highest signal strength; and transmitting the audio stream from the point of sale system to a selected device from the plurality of devices that is associated with the identified one of the received radio signals.

Optionally, the method further comprises: requesting the selected device to provide an identifier of a contralateral device; receiving the identifier from the selected device; and transmitting the audio stream to the contralateral device.

A hearing aid configured to communicate with a point of sale system, includes: a processing unit; and a wireless transceiver; wherein the wireless transceiver is configured to: send a request for a securely transmitted audio stream from the point of sale system that is in communication with a plurality of devices including the hearing aid, and receive the audio stream from the point of sale system after the point of sale system has confirmed the hearing aid as a receiving device based at least in part on a measurement value associated with the hearing aid.

Optionally, the wireless transceiver is further configured to send a radio frequency signal for detection by the point of sale system.

Other and further aspects and features will be evident from reading the following detailed description.

BRIEF DESCRIPTION OF THE DRAWINGS

The drawings illustrate the design and utility of various features described herein, in which similar elements are referred to by common reference numerals. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

FIG. 3 shows an embodiment of a list which may be stored in a memory of the point of sale.

DETAILED DESCRIPTION

Figure 1:
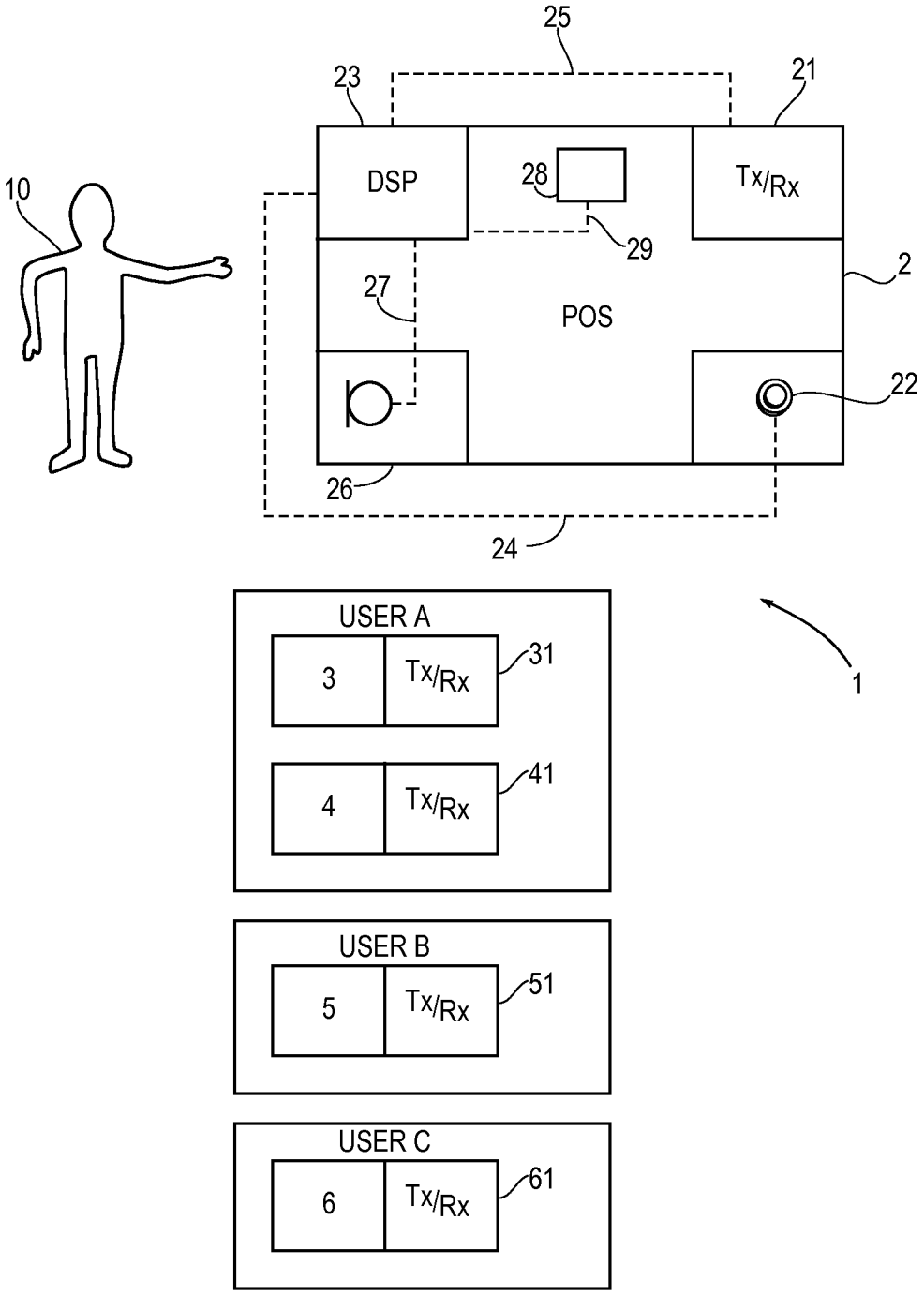
FIG. 1 shows a point of sale system.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated.

In an embodiment, a hearing device may be a hearing aid such as an in the ear (ITE) hearing aid, a behind the ear (BTE) hearing aid, a completely in the canal (CIC) hearing aid or the like.

FIG. 1 shows a point of sale system 1 comprising a point of sale 2 and a number of devices 3, 4, 5, and 6.

The point of sale 2 may comprise a microprocessor 23, a transceiver (TX/RX) 21 such as a RF transceiver, an input transducer 26 such as a microphone, and an activator 22. The point of sale 2 may in an embodiment be contained in a ticket office, a bank counter, a post office or the like.

The activator 22 may be embodied as a push button or the like. The activator 22 may be communicatively coupled to the microprocessor 23 wirelessly, e.g. via Bluetooth or the like, or wired, e.g. via a cable or the like, via link 24.

The transceiver 21 may be embodied as a transmitter and a receiver configured for transmitting and/or receiving wireless data from at least one of the number of devices 3, 4, 5, and 6. The transceiver 21 may be communicatively coupled to the microprocessor 23 wirelessly, e.g. via Bluetooth or the like, or wired, e.g. via a cable or the like, via link 25. In an embodiment, the transceiver may be configured for transmitting and/or receiving wireless data from a plurality of devices 3, 4, 5, and 6. In an embodiment, the transceiver 21 may communicate with the at least one of the number of devices 3, 4, 5, and 6 or the plurality of devices 3, 4, 5, and 6 via a wireless communication interface in an industrial, scientific and medical (ISM) band such as Bluetooth or a Bluetooth-like communication protocol as mentioned under the summary, i.e. in a 2.4-2.5 GHz band.

The input transducer 26 may be embodied as a microphone directed towards a person 10 controlling the point of sale 2 such as a clerk or the like.

The microprocessor 23 may be a central processing unit (CPU), a digital signal processor (DSP) or the like. In an embodiment, the microprocessor 23 may be configured for processing data to and/or from the activator 22. In an embodiment, the microprocessor 23 may be configured for transmitting and/or receiving data via the transceiver 21. In an embodiment, the microprocessor may be configured for receiving data from the activator 22. In an embodiment, the microprocessor 23 may be adapted to control on or more features of activator 22 such as e.g. tactile resistance, tactility, color, or the like.

Each of the devices 3, 4, 5, and 6 may comprise a transceiver 31, 41, 51, 61, such as a RF transceiver. In an embodiment, the device 3 may represent a first hearing aid, the device 4 may represent a second hearing aid, the device 5 may represent a mobile telephone, and the device 6 may represent a tablet personal computer, each of which may contain a transceiver 31, 41, 51, 61, configured for wireless transmission and/or reception of data.

The transceivers 31, 41, 51, 61 may be configured for wireless communicative coupling to the point of sale 2. In an embodiment, the transceivers 31, 41, 51, 61 may be configured for transmitting and/or receiving wireless data to and/or from the point of sale 2. In an embodiment, the transceivers 31, 41, 51, 61 may communicate wirelessly with the point of sale 2 via a wireless communication interface in an industrial, scientific and medical (ISM) band such as Bluetooth or a Bluetooth-like communication protocol as mentioned under the summary, i.e. in a 2.4-2.5 GHz band.

In an embodiment, the first 3 and second 4 hearing aids may be carried by a first user A, mobile telephone 5 may be carried by a second user B and tablet personal computer 6 may be carried by third user C. The users A, B, and C may be waiting to be served by point of sale 2. For example, user A may be the next to be served at the point of sale 2, user B may be behind user A i.e. waiting to be served after user A, and user C may be behind user B, i.e. waiting to be served after user B.

When a hearing device carrying person such as user A is to be served by point of sale 2, the person may activate activator 22 e.g. by pushing a push-button. The activation of activator 22 indicates that user A would like to have an audio stream presented to the first and second hearing devices. Once activated, an active-signal may be transmitted from the activator 22 to the microprocessor 23 indicating an activation of the activator 22. The active-signal may activate a routine or algorithm in microprocessor 23 which turns on a receiver-part of the transceiver 21.

The receiver-part of the transceiver 21 may detect radio frequency signals transmitted from one or more of the devices 3, 4, 5 and 6. In an embodiment, the receiver-part of the transceiver 21 may detect a first radio frequency signal transmitted from device 3, a second radio frequency signal transmitted from device 4, a third radio frequency signal transmitted from device 5, and a fourth radio frequency signal transmitted from device 6. In an embodiment, the receiver-part of the transceiver 21 may detect a radio frequency signal transmitted from a proper subset of the devices 3, 4, 5, and 6 e.g. from the subset comprising devices 3, 4, 6.

In an embodiment, the radio frequency detection may be performed in a period of time such as two seconds or the like from the activation of the activator 22. In an embodiment, the point of sale 2 may be configured to perform the radio frequency detection continuously prior to, during and after the activation of the activator 22.

In an embodiment, the radio frequency signals transmitted by the first and/or second hearing aid may be radio beacons transmitted at a regular period such as once every second or the like. In a further embodiment, one or both of devices 5 and 6 may also be configured for transmitting similar radio beacons at a regular period.

The radio frequency signals detected by the receiver-part of the transceiver 21 may be transmitted from the transceiver 21 to the microprocessor 23 via link 25. In an embodiment, the detected radio frequency signals may be transmitted from the transceiver 21 to the microprocessor 23 after the expiry of the detection period e.g. two seconds. In an embodiment, the detected radio frequency signals may be transmitted from the transceiver 21 to the microprocessor 23 at the time of activation of the activator 22 or within a second or the like of the activation of the activator.

In an embodiment, the microprocessor 23 may calculate and/or measure and/or determine a quality value for each of the devices 3, 4, 5, and 6 based on the respective detected radio frequency signals received from the transceiver 21. The microprocessor may further associate the respective quality value to each of the devices 3, 4, 5, and 6. In an embodiment, the quality value may be a received signal strength indicator RSSI. In an embodiment, the quality value may be received channel power indicator RCPE. In an embodiment, the quality value may be signal to noise ratio SNR.

Based on the quality values, the microprocessor 23 may select the device with the largest/highest quality value for reception of an audio stream. Thereby, the selected device is the one providing the largest/highest detected radio frequency signal to the transceiver 21 of the point of sale 2. In an embodiment, the largest/highest quality value of the selected device may indicate that a user carrying the selected device is closest to the point of sale 2 at the time of activation of the activator 22.

In an embodiment, the quality value may be RSSI and the transceiver 21 may have detected a high amplitude radio frequency signal from device 3, the transceiver 21 may have detected a medium-low amplitude radio frequency signal from device 4, the transceiver 21 may have detected a medium-high amplitude radio frequency signal from device 5, and the transceiver 21 may have detected a low amplitude radio frequency signal from device 6, at or near the time of activation of the activator 22.

Based on the detected radio frequency signal from device 3, the microprocessor 23 may calculate and/or measure and/or determine a quality value associated with device 3. The microprocessor 23 may for example associate a RSSI value of 4 (large/high value) with device 3. Based on the detected radio frequency signal from device 4, the microprocessor 23 may calculate and/or measure and/or determine a quality value associated with device 4. The microprocessor 23 may for example associate a RSSI value of 2 (medium-low value) with device 4. Based on the detected radio frequency signal from device 5, the microprocessor 23 may calculate and/or measure and/or determine a quality value associated with device 5. The microprocessor 23 may for example associate a RSSI value of 3 (medium high value) with device 5. Based on the detected radio frequency signal from device 6, the microprocessor 23 may calculate and/or measure and/or determine a quality value associated with device 6. The microprocessor 23 may for example associate a RSSI value of 1 (low value) with device 6.

In an embodiment, the calculated and/or measured and/or determined quality values may be stored in a list in a memory 28 such as a RAM communicatively coupled to the microprocessor 23 via communication link 29 or included in the microprocessor 23. The stored quality values may be associated with an identifier representing the respective device such that an entry in the list in the memory 28 may contain an identifier associated with device 3 and the quality value calculated and/or measured and/or determined for device 3. Similarly for the other devices as seen in FIG. 3 below. In an embodiment, the microprocessor 23 may further be configured for setting a flag for each entry in the list indicating whether the device identified by said entry supports audio streaming. The detected devices 3, 4, 5, and 6 may in an embodiment transmit information regarding streaming capabilities to the transceiver 21 which the microprocessor 23 may utilize to set the flag.

Based on the associated quality values, the microprocessor 23 may determine that device 3 is closest to the point of sale 2 due to the highest/largest quality value. Thus, the microprocessor 23 may select device 3 as the device to which the point of sale 2 is to stream an audio stream because device 3 has the highest/largest quality value and thus device 3 fulfills the selection criterion that it has the largest/highest quality value of the devices detected by the transceiver 21.

Subsequently, the microprocessor 23 may activate the microphone 26 in order to convert an analog voice signal of the clerk 10 into a digital voice signal. The digital voice signal may be transmitted from microphone 26 to microprocessor 23 via link 27 and from microprocessor 23 to transceiver 21 via link 25. Further, the microprocessor 23 may control the transceiver 21 to transmit a digital audio stream representing the digital voice signal to the selected device i.e. device 3. The microprocessor may in this way 23 control the transceiver 21 to stream the voice signal from the clerk 10 to the user A carrying device 3 thereby ensuring a private secure transmission of audio data from the point of sale 2 to the selected device 3. In an embodiment, the microphone 26 is continuously active i.e. before, during and after the activation of activator 22, and the microprocessor processes the audio signal from the microphone 26 continuously i.e. before, during and after activation of activator 22. In an embodiment, the microprocessor 23 processes the audio signal from the microphone 26 when the activator 22 has been activated.

In an embodiment, the microprocessor 23 may encrypt the digital voice signal according to an encryption algorithm such that the transceiver 21 transmits an encrypted audio stream to the device 3. In an embodiment, the encryption algorithm may be selected from the group consisting of private-key encryption and public-key encryption.

In an embodiment, at least one of the devices 3, 4, 5, and 6 is configured for including a radio beacon in the radio frequency signals transmitted from the at least one devices 3, 4, 5, and 6 to the transceiver 21 of the point of sale 2. In an embodiment, all the devices 3, 4, 5, and 6 are configured for including a radio beacon in the radio frequency signals transmitted from the respective device 3, 4, 5, and 6 to the transceiver 21 of the point of sale 2.

In an embodiment, the selected device 3 may be communicatively coupled to a contra-lateral device 4 e.g. in a binaural hearing aid system. The point of sale 2 may be configured for requesting the selected device 3 an identifier associated with the contra-lateral device 4. When the microprocessor 23 selects the selected device 3 based on the quality value, the microprocessor 23 may transmit a request to the selected device 3 via transceiver 21. The request may contain a request for an identifier of a contra-lateral device 4. The selected device 3 may be configured for responding to the request by transmitting an identifier identifying the contra-lateral device 4 to the microprocessor 23 via transceiver 21 if such a contra-lateral device 4 exists; otherwise the selected device 3 may respond with a predetermined code e.g. a zero or the like. The microprocessor 23 may store the identifier of the contra-lateral device 4 in the memory 28. In an embodiment, the identifier of the contra-lateral device 4 is marked as associated with the selected device 3 in the memory. Subsequently, the point of sale 2 may stream the voice signal from the clerk 10 to the selected device 3 and the contra-lateral device 4. Thereby is ensured that the contra-lateral device 4 is uniquely identified. Due to shadow effects the contra-lateral device 4 may be provide a substantially less strong signal to the transceiver 21 of the point of sale 2 than the selected device 3 and therefore selection of the contra-lateral device based on the list may be faulty. The method of requesting an identifier for a contra-lateral device removes this problem.

In an embodiment, the point of sale 2 may continue to stream audio data to the device 3 and possibly also device 4 if identified, until the clerk 10 or the user A stops the stream by deactivating the activator 22.

In an embodiment, the point of sale 2 may continue to stream audio data to the device 3 and possibly also device 4 if identified, until the point of sale 2 no longer receives any radio frequency signals from the devices 3 and 4 i.e. until the distance between the devices 3 and 4 and the point of sale 2 are greater than a transmission distance of the devices 3 and 4 e.g. eight to 10 meters.

In an embodiment, the point of sale 2 may continue to stream audio data to the device 3 and possibly also device 4 if identified, until the user A activates a button on one of the devices 3 and 4, which activation enables the device 3 and/or device 4 to transmit a signal to the microprocessor 23 via transceiver 21 indicating a stop of the stream. Subsequently after reception of the stop signal from one or both of devices 3 and 4, the point of sale 2 stops streaming the audio stream to the devices 3 and 4.

Figure 2:
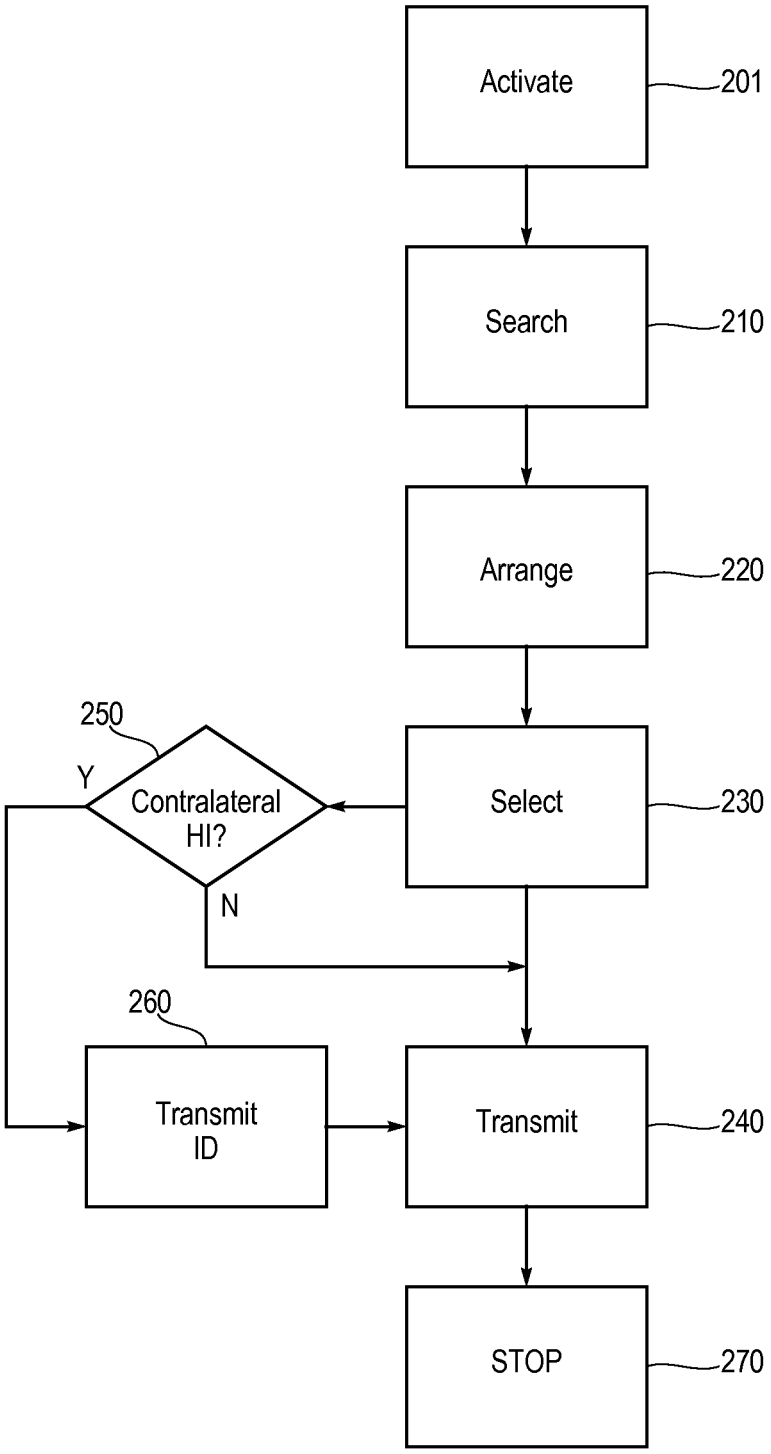
FIG. 2 shows an embodiment of a method of secure streaming of audio data to a device.

FIG. 2 shows an embodiment of a method of securely transmitting an audio stream from a point of sale 2 to a device such as a hearing device 3.

In a first step, step 201, a user A activates an activator 22 of at the point of sale 2.

The activation of the activator 22 starts a second step, a search step 210, wherein the point of sale 2 searches for wireless radio frequency signals. The search is performed by the transceiver 21 controlled by the microprocessor 23 via link 25. The wireless radio frequency signals sought after by the point of sale 2 may be emitted by the device 3 carried by user A, by device 4 also carried by user A, by device 5 carried by user B and device 6 carried by user C.

In an embodiment, the search is carried out continuously by the point of sale 2 i.e. before, during and after the activation of the activator 22. When the activator 22 is activated, the devices 3, 4, 5, and 6 detected by the transceiver 21 at the moment of activation, are stored in a list or the like in a memory 28 communicatively coupled to the microprocessor 23 via link 29 together with identification information (such as Device ID profile DIP as known from Bluetooth) and signal strength and/or quality (for example RSSI) for each of the detected devices 3, 4, 5, and 6.

In an embodiment, the search is carried out in a period of time e.g. two seconds or the like after the activation of the activator. When the activator 22 is activated, the devices 3, 4, 5, and 6 detected by the transceiver 21 in the two seconds (or the like) after the activation of the activator 22, are stored in a list or the like in a memory 28 communicatively coupled to the microprocessor 23 together with identification information and signal strength and/or quality for each of the detected devices 3, 4, 5, and 6.

In an embodiment, the microprocessor 23 may order and/or arrange, in a step 220, the items in the list according to the signal strength such that the device with the highest signal strength detected by transceiver 21 at the time of activation of activator 22 is placed in the top of the list.

Based on the measured signal strength of the detected devices 3, 4, 5, and 6, the point of sale 2 selects, in a step 230, the device with the highest signal strength at the time of activation or shortly thereafter.

In a subsequent step 240, the point of sale 2 starts to stream audio data from a microphone 26 recording voice data from the clerk 10 to the device 3 carried by user A having activated the activator 22.

In an embodiment, the point of sale 2 may request an identifier, in a step 250 following step 230, from the selected device 3 to a contra-lateral device 4 communicatively coupled to a selected device 3 e.g. via a wireless communication protocol. Due to shadow effects and the like, the contra-lateral device 4 need not be subsequent to the selected device in the list in the memory.

In a subsequent step 260, the selected device 3 may transmit an identifier of the contra-lateral device 4 to the point of sale 2.

The point of sale may subsequently stream audio data from a microphone 26 recording voice data from a person 10 using the point of sale 2 to the selected device 3 and the contra-lateral device 4 carried by user A having activated the activator 22 in step 240.

The streaming of audio data from the point of sale 2 to the device 3 and device 4 if identified stops in step 270 when the clerk 10 or user A deactivates the activator 22, and/or when the devices 3 and 4 are no longer able to transmit radio frequency signals to the point of sale 2 and/or when the user A activates a button on one or both of devices 3 and 4 making device 3 and/or 4 transmit a stop signal to the point of sale 2 as disclosed above.

FIG. 3 shows an embodiment of a list which may be stored in a memory 28 of the point of sale 2 by the microprocessor 23. The list 301 may contain a column 302 containing identifiers for each of the devices 3, 4, 5, and 6 detected by the transceiver 21. Further, the list may contain a column 303 containing a quality value for each of the detected devices 3, 4, 5, and 6 measured and/or calculated and/or determined by the microprocessor 23 via detected signals received from transceiver 21 via link 25. Additionally, the list may contain a column 304 containing a flag or a binary value for each of the detected devices 3, 4, 5, and 6 indicating whether the device supports audio streaming. In FIG. 3, a binary value of 1 may indicate that audio streaming is enabled in the device and a binary value of 0 may indicate that audio streaming is disabled.

Although the point of sale 2 has been described as having a microprocessor 23, it should be noted that the point of sale 2 may include any processing unit configured to perform the features described herein. As used in this specification, the term "processing unit" is not limited to a certain type of processor, and may refer to one or more processors, such as a FPGA processor, an ASIC processor, a general purpose processor, a signal processor, or any of other types of processor. Also, the "processing unit" may be implemented using hardware, software, or combination of both hardware and software. Furthermore, the "processing unit" may refer to any integrated circuit, or a portion of an integrated circuit.

One or more embodiments described herein may include one or more aspects according to one or more of the items below.

1. A point of sale system comprising:
a transceiver;
an activator; and
a processing unit;
wherein the transceiver is configured for, upon activation of the activator, detecting radio frequency signals transmitted from at least one device;
wherein the processing unit is configured for:
associating a measurement value with each of the at least one device,
selecting a device from the at least one device for reception of an audio stream, based on the measurement value of the device fulfilling at least one selection criteria, and
operating the transceiver to transmit the audio stream to the selected device.

2. The point of sale system according to item 1, wherein at least one of the at least one device is a hearing device configured for wireless audio streaming.

3. The point of sale system according to item 2, wherein the activator is configured for activation in response to a request from a user of the hearing device for a securely transmitted audio stream to be provided from the point of sale system.

4. The point of sale system according to item 1, wherein the radio frequency signals comprises radio beacons.

5. The point of sale system according to item 1, wherein the measurement value comprises a radio frequency signal strength.

6. The point of sale system according to item 1, wherein the processing unit is configured to assess each of the at least one device according to the measurement value associated with the each of the at least one device.

7. The point of sale system according to item 1, wherein the processing unit is configured to use a strength of the radio frequency signals transmitted from the at least one device as a signal strength indication for data reception by the at least one device at a point of sale.

8. The point of sale system according to item 1, wherein the processing unit is configured to set a receiving value for each of the at least one device indicating whether the each of the at least one device supports audio streaming.

9. The point of sale system according to item 8, wherein the processing unit is configured to select the device also based on the receiving value.

10. The point of sale system according to item 1, wherein the processing unit is further configured for requesting the selected device to provide an identifier of a contralateral device.

11. The point of sale system according to item 10, wherein the transceiver is configured for receiving the identifier from the selected device.

12. The point of sale system according to item 11, wherein the processing unit is configured to operate the transceiver for transmitting the audio stream to the selected device and the contralateral device.

13. The point of sale according to item 1, wherein the at least one device comprises a plurality of devices, and the selection criteria comprises selecting one of the plurality of devices that has a highest measurement.

14. A method of streaming audio data from a point of sale system to a hearing device, wherein the point of sale system comprises a transceiver and an activator, comprising:
activating the activator in response to a request from a user of the hearing device for a securely transmitted audio stream from the point of sale system to the hearing device;
searching for radio signals from a plurality of devices including the hearing device receivable by the transceiver of the point of sale system;
identifying one of the received radio signals having a highest signal strength; and
transmitting the audio stream from the point of sale system to a selected device from the plurality of devices that is associated with the identified one of the received radio signals.

15. The method according to item 14, wherein the method further comprises:
requesting the selected device to provide an identifier of a contralateral device;
receiving the identifier from the selected device; and
transmitting the audio stream to the contralateral device.

16. A hearing aid configured to communicate with a point of sale system, comprising:
a processing unit; and
a wireless transceiver;
wherein the wireless transceiver is configured to:
send a request for a securely transmitted audio stream from the point of sale system that is in communication with a plurality of devices including the hearing aid, and
receive the audio stream from the point of sale system after the point of sale system has confirmed the hearing aid as a receiving device based at least in part on a measurement value associated with the hearing aid.

17. The hearing aid according to item 16, wherein the wireless transceiver is further configured to send a radio frequency signal for detection by the point of sale system.

18. A point of sale system comprising a transceiver and an activator; wherein the point of sale system is configured for upon activation of the activator, detecting radio frequency signals transmitted from at least one device configured for wireless transceiving; and associating a measurement value to each of the at least one device;

selecting a device for reception of an audio stream from the at least one device, wherein said selected device being selected by having a measurement value fulfilling at least one selection criteria; and transmitting an audio stream to said selected device.

19. A point of sale system according to item 18, wherein at least one of the at least one device is a hearing device configured for wireless audio streaming.

20. A point of sale system according to item 19, wherein the activator is activated by a user of the hearing device once the user is to be served at the point of sale system.

21. A point of sale system according to anyone of items 18 to 20, wherein the radio frequency signals comprises radio beacons.

22. A point of sale system according to anyone of items 18 to 21, wherein the measurement value comprises a radio frequency signal strength.

23. A point of sale system according to anyone of items 18 to 22, wherein the point of sale system is further configured for arranging the at least one device according to the measurement value.

24. A point of sale system according to item 22, wherein the radio frequency signal strength of the at least one device is detected as a received signal strength indication at the point of sale.

25. A point of sale system according to item 23, wherein the arranging further comprises setting a receiving value for each of the at least one transmitting devices indicating whether the at least one transmitting device supports audio streaming.

26. A point of sale system according to item 25, wherein the selection is further performed based on the receiving value.

27. A point of sale system according to anyone of items 18 to 26, wherein the point of sale system is further configured for requesting the selected device an identifier of a contralateral device.

28. A point of sale system according to item 27, wherein the point of sale system is further configured for receiving the identifier from the selected device.

29. A point of sale system according to item 28, wherein the point of sale system is further configured for transmitting the audio stream to the selected device and the contralateral device.

30. A point of sale according to anyone of items 18 to 29, wherein the selection criteria comprises the measurement value of the selected device being larger than the measurement value of another device.

31. A method of securely streaming audio data from a point of sale to a hearing device, wherein each of the hearing device and the point of sale comprises a transceiver, and wherein the point of sale further comprises an activator; the method comprising Activating the activator by a user of the hearing device thereby indicating a request for a securely transmitted audio stream from the point of sale to the hearing device;

Searching for radio signals from a number of devices including the hearing device receivable by the point of sale transceiver;

Arranging the received radio signals according to signal strength;

Transmitting the audio stream from the point of sale to a selected device from the number of devices having the strongest signal.

32. A method according to item 31, wherein the method further comprises

Requesting the selected device an identifier of a contralateral device;

Receiving the identifier from the selected device;

Transmitting the audio stream to the selected device and the contralateral device.

33. A hearing aid comprising a wireless transceiver, wherein the wireless transceiver of the hearing aid is configured for receiving an audio stream transmitted by a point of sale system according to anyone of items 18 to 30.

34. A hearing aid according to item 33, wherein the wireless transceiver of the hearing aid is further configured for transmitting a radio frequency signal for detection by the point of sale system.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A point of sale system comprising:

a transceiver;

an activator; and a processing unit;

wherein the transceiver is configured for, upon activation of the activator, detecting radio frequency signals transmitted from a plurality of devices;

wherein the processing unit is configured for:

obtaining measurement values associated respectively with the plurality of devices based on the detected radio frequency signals, selecting a device from the plurality of devices for reception of an audio stream, based on at least one of the measurement values fulfilling at least one selection criteria, and operating the transceiver to transmit the audio stream to the selected device; and wherein the processing unit is configured to select the device after the measurement values are obtained.

2. The point of sale system according to claim 1, wherein at least one of the devices is a hearing device configured for wireless audio streaming.

3. The point of sale system according to claim 2, wherein the activator is configured for activation in response to a request from a user of the hearing device for a securely transmitted audio stream to be provided from the point of sale system.

4. The point of sale system according to claim 1, wherein the measurement value indicates a radio frequency signal strength.

5. The point of sale system according to claim 1, wherein the processing unit is configured to use a strength of one of the radio frequency signals as a signal strength indication for data reception by the selected device at a point of sale.

6. The point of sale system according to claim 1, wherein the processing unit is further configured for requesting the selected device to provide an identifier of a contralateral device;

wherein the transceiver is configured for receiving the identifier from the selected device; and wherein the processing unit is configured to operate the transceiver for transmitting the audio stream to the selected device and the contralateral device.

7. The point of sale according to claim 1, wherein the at least one selection criteria comprises selecting one of the plurality of devices that has a highest measurement.

8. A method of streaming audio data from a point of sale system to a hearing device, wherein the point of sale system comprises a transceiver and an activator, comprising:

activating the activator in response to a request from a user of the hearing device for a securely transmitted audio stream from the point of sale system to the hearing device;

searching for radio signals from a plurality of devices including the hearing device receivable by the transceiver of the point of sale system;

identifying one of the received radio signals having a highest signal strength;

selecting a device from the plurality of devices that is associated with the identified one of the received radio signals; and transmitting the audio stream from the point of sale system to the selected device.

9. The method according to claim 8, wherein the method further comprises:

requesting the selected device to provide an identifier of a contralateral device;

receiving the identifier from the selected device; and transmitting the audio stream to the contralateral device.

10. A hearing aid configured to communicate with a point of sale system, comprising:

a processing unit; and a wireless transceiver;

wherein the wireless transceiver is configured to:

send a request for a securely transmitted audio stream to be provided from the point of sale system, the point of sale system configured to select one of a plurality of devices including the hearing aid, and receive the audio stream from the point of sale system after the point of sale system has selected the hearing aid as a receiving device based at least in part on a measurement value associated with the hearing aid.

11. The point of sale system of claim 1, wherein the transceiver of the point of sale system is configured to detect additional radio frequency signals from an additional device, wherein the at least one device and the additional device are for different respective users, and wherein each of the at least one device and the additional device comprises a hearing device or a communication device.

12. The method of claim 8, wherein the devices are for different respective users, and wherein the devices comprise an additional hearing device or a communication device.

13. The hearing aid of claim 10, wherein the devices are for different respective user, and wherein the devices comprise an additional hearing aid or a communication device.

14. A point of sale system comprising:

a transceiver;

an activator; and a processing unit;

wherein the transceiver is configured for, upon activation of the activator, detecting radio frequency signals transmitted from multiple devices;

wherein the processing unit is configured for:

obtaining measurement values associated with the respective devices based on the detected radio frequency signals, the measurement values comprising at least a first measurement value and a second measurement value, selecting one of the devices for reception of an audio stream, based on the measurement values of the devices, and operating the transceiver to transmit the audio stream to the selected device; and wherein the processing unit is configured to select one of the devices after the measurement values are obtained.

15. The point of sale system of claim 14, wherein the multiple devices comprise multiple hearing aids.

16. The point of sale system of claim 14, wherein the multiple devices comprise at least one device configured for placement behind an ear of a user.

17. The point of sale system of claim 14, wherein the multiple devices comprise at least one device configured for placement in an ear of a user.

18. The point of sale system of claim 14, wherein the multiple devices comprise at least one device configured for placement in an ear canal of a user.

19. The point of sale system of claim 14, wherein the processing unit of the point of sale system is configured to select the one of the devices after the radio frequency signals are detected by the transceiver of the point of sale system.

* * * * *